United States Patent [19]

Michel et al.

[11] Patent Number: 4,618,286

[45] Date of Patent: Oct. 21, 1986

[54] COMPOSITE PLATFORM FOR PETROLEUM WORKINGS IN POLAR SEAS

[75] Inventors: Dominique Michel, Paris, France; Delbert B. Johnson, Houston, Tex.; Jean F. Pagès, Paris, France; Vincent F. P. Foglia, Aulnay-sous-Bois, France; Jean G. M. Martin, Paris, France; Michel P. Vaché, Combs-la-Ville, France; François G. Sedillot, Velizy, France; Carroll M. Crull, Houston, Tex.

[73] Assignee: Fluor-Doris Incorporated, Houston, Tex.

[21] Appl. No.: 700,950

[22] Filed: Feb. 12, 1985

[30] Foreign Application Priority Data

Feb. 16, 1984 [FR] France ..... 84 02345

[51] Int. Cl.[4] ..... B63B 35/44; E02B 17/00; E02D 5/54

[52] U.S. Cl. ..... 405/208; 405/217; 405/227

[58] Field of Search ..... 405/61, 195, 203–205, 405/207, 208, 210, 211, 217, 224, 227, 228; 175/9

[56] References Cited

U.S. PATENT DOCUMENTS

| | | | |
|---|---|---|---|
| 3,751,930 | 8/1973 | Mott et al. | 405/208 X |
| 3,754,403 | 8/1973 | Mott et al. | 405/208 X |
| 3,766,737 | 10/1973 | Howard | 405/61 |
| 3,831,385 | 8/1974 | Hudson et al. | 405/211 |
| 3,952,527 | 4/1976 | Vinieratos et al. | 405/217 |
| 4,245,929 | 1/1981 | Pearce et al. | 405/217 X |
| 4,397,586 | 8/1983 | Weiss | 405/217 |
| 4,422,804 | 12/1983 | Gerwick | 405/211 X |
| 4,486,125 | 12/1984 | Reusswig | 405/203 X |
| 4,497,594 | 2/1985 | Fern | 405/203 X |

FOREIGN PATENT DOCUMENTS

| | | | |
|---|---|---|---|
| 433272 | 7/1974 | U.S.S.R. | 405/217 |

*Primary Examiner*—Cornelius J. Husar
*Assistant Examiner*—Nancy J. Stodola
*Attorney, Agent, or Firm*—A. W. Breiner

[57] ABSTRACT

The platform comprises an annular truncated cone of concrete which constitutes the main resistant element of the platform and is designed to take the thrust of ice, and a cylindrical steel part housed inside the annular truncated cone. Watertight passages parallel to the generatrices of the cylindrical wall are provided to house piles in the peripheral ring, close to the wall. A watertight passage well is provided in the cylindrical steel part for the passage of the drill pipes. A circular running track is provided for gantry cranes used for piles handling. The platform has two drilling rigs placed on one half of the platform and able to work simultaneously.

6 Claims, 5 Drawing Figures

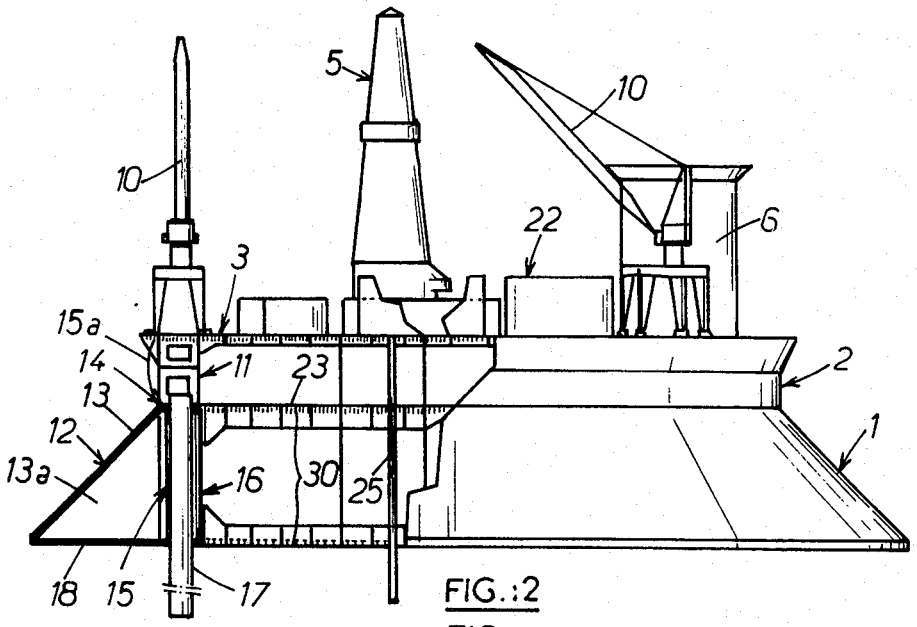
FIG.:2
FIG.:3
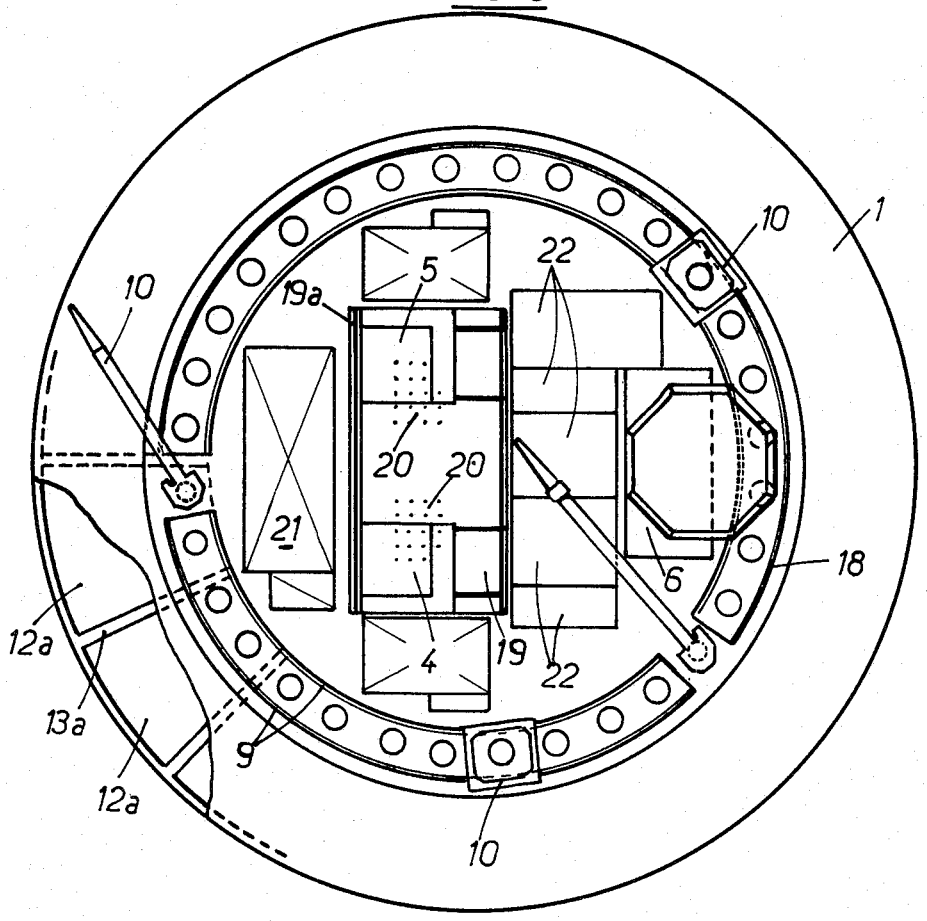

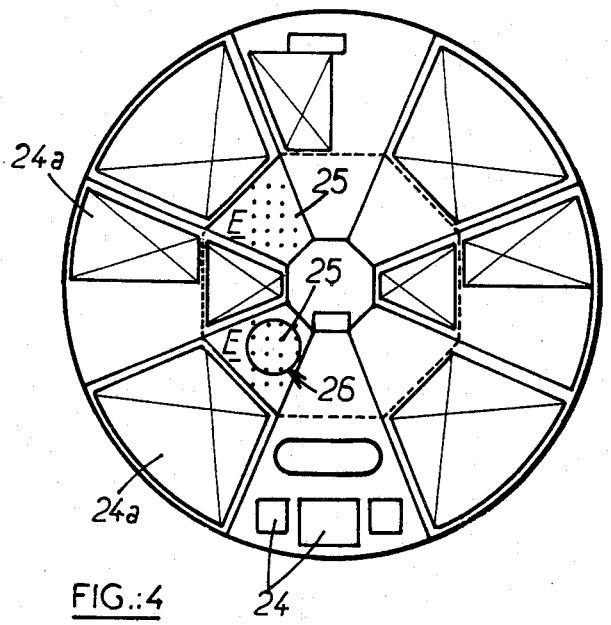
FIG.:4
FIG.:5
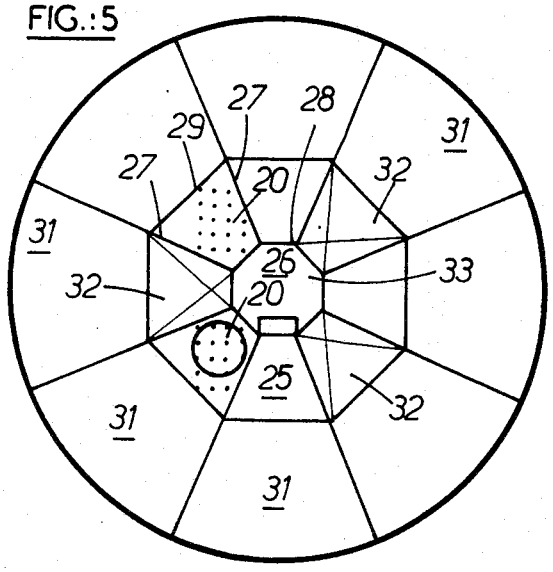

COMPOSITE PLATFORM FOR PETROLEUM WORKINGS IN POLAR SEAS

The invention relates to a composite platform for petroleum workings in polar seas, comprising an annular frustoconical part supported on the seabed, a central cylindrical part, the internal volume of these two parts forming ballastable tanks, and a deck supporting the drilling and production equipment.

Platforms for petroleum prospection or production in polar seas are known, in which the base is provided in the ice formation zone with a rising conical part extended above sea level. The conical surface forms a ramp on which the layer of ice rises under the thrust of the pack before being broken up. A construction of this kind makes it possible to limit the overturning forces exerted by the pack, and consequently to use constructions of reasonable dimensions and weights.

U.S. Pat. No. 3,831,385 describes a platform of the abovedescribed type, which comprises, around a central cylindrical shaft, a conical wall fixed on the base. This wall extends above sea level and cooperates with the top of the trunk to give the deck support. The annular conical space forms, at least in part, a ballastable tank which is filled with water when the platform is placed on the site, and thus contributes to the anchoring on the seabed. The platform is provided with telescopic legs disposed in a ring inside the cylindrical shaft. At their bottom ends the legs carry widened parts limiting penetration into the ground, particularly during positioning on the site. The positioning is made by lowering the legs to the seabed and then ballasting the platform, which is guided along the legs. The platform can be raised again by reversing the operations of site positioning, i.e. by removing the ballast from the tanks in order to obtain a slightly negative buoyancy, and raising the platform along the legs by means of the jacking system. The platform includes a central derrick, the drilling string passing through the watertight bottom of the central shaft. When used for prospecting work, and when shifting of the platform to another place is necessary, the drilling casings are cut and the opening drilled in the concrete bottom is closed watertight.

The polar seas in which oil prospection takes place at the present time have generally shallow depths and a soft sea bed with poor cohesion. As the platforms are towed afloat to the installation site, their draught must be small. On the other hand, their weight is considerable because of the great thicknesses of concrete necessary to withstand ice pressure. These opposite requirements are at present difficult to reconcile.

The invention seeks to provide a platform of a type similar to that described above but reconciling a shallow draught with the necessary conical concrete wall strength. The platform according to the invention makes it possible to reduce the drilling time by simultaneous drilling with two rigs on two different well clusters, and also to shorten the time necessary to move the platform to a new place, during the prospecting phase, by using as drilling pipes passages which are watertight fixed on the platform bottom. The platform also makes it possible to go from the prospecting phase to the production phase without modification or rearrangement of equipment.

The explanations and figures given below, by way of example, will make it possible to understand how the invention is realized.

FIG. 2 is a view in elevation and partly in section of the platform shown in FIG. 1.

FIG. 3 is a top view of the platform.

FIG. 4 is a top view of the lower deck.

FIG. 5 is a view at the level of the bottom of the platform.

Figure 1:
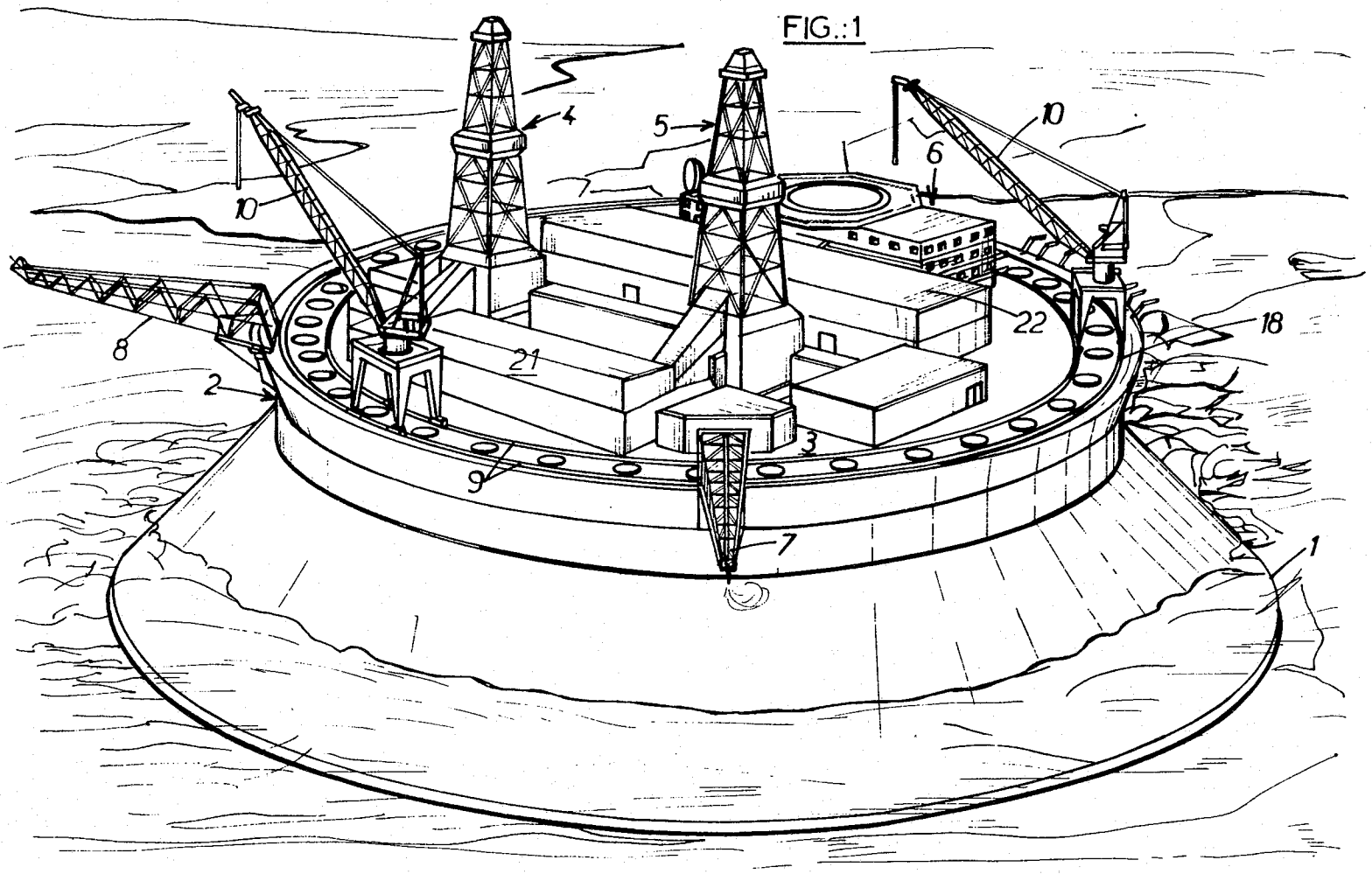
FIG. 1 shows in perspective a platform according to the invention.

The platform according to the invention, shown in FIG. 1, is of the weight base type, and comprises a frustoconical base 1 directed from bottom to top where it joins the central cylindrical body 2 which supports the circular deck 3 on which are provided the technical installations and the living quarters. According to one feature of the invention the platform carries two drilling derricks 4, 5 disposed on the same side in respect to a diameter, the living quarters 6 being placed at the opposite part of the deck. In conventional manner each drilling rig has associated with it a flare stack 7, 8. A circular running track 9 is provided on the periphery of the deck for the movement of the pile lifting means which, as shown, consist of travelling gantry cranes 10.

FIG. 2 is a view in partial section of the platform according to the invention. The platform is composed of an inner cylindrical part 11 forming the central cylindrical body 2, and an outer frustoconical base having the shape of an annular truncated cone 12. This annular truncated cone 12 is then a part of the base 1 and constitutes a watertight construction divided by radial partition walls 13*a* into a certain number of ballastable tanks 12*a*. The section of the annular truncated cone 12 has the form of a right-angled triangle laid on the seabed along one side of the right angle. The apex of the triangle, opposite the side resting on the bed, is truncated and remains above the sea-level forming a peripheral ring 14 from which the cylindrical body 2 is a side.

The annular truncated cone 12, which has to withstand the thrust of the ice, has a thick inclined wall 13 stiffened by radial partition walls 13*a* bounding the ballastable tanks 12*a*. According to the embodiment of the invention the annular truncated cone 12 is made of concrete and built by conventional techniques in a dry lock. The top peripheral ring 14 carries, at regular spaces, vertical watertight passage tubes 15 parallel to the generatrices of the inner cylindrical wall 16 of the annular truncated cone 12, and are placed near that wall. The vertical tubes 15 are intended to receive piles 17 which serve to fasten the annular truncated cone 12 to the seabed. The height of the annular truncated cone 12 is greater than the greatest height reached by floating ice.

The assembly formed by the annular truncated cone 12 and its radial partitions 13*a* has a great rigidity and constitutes the resistant structure of the platform, able to withstand the dynamic forces due to swell, wind, current, during towing, capable of protecting the entire internal structure against the thrust of ice after installation at the worksite, and transmit to the piles the shear forces due to this thrust, so that the piles transmit them to the seabed.

The central cylindrical body 2 is composed of an inner cylindrical part 11 closed at the base to provide a watertight volume inside the inner cylindrical wall 16 of the annular truncated cone 12.

Together with the annular truncated cone 12, and more particularly with its face 18, the bottom of the central cylindrical body 2 forms the resting base of the platform.

The central cylindrical body 2 is made of steel, that may be built in a workshop separate from that where the concrete annular truncated cone is poured. The central trunk does not withstand the ice thrust but holds the water pressure below its bottom face and the installations weight inside and at its top end, needs a limited amount of steel and has a low weight compared with the displaced volume of water.

When the annular truncated cone and the prefabricated elements of the inner cylindrical part, have been completed separately, the prefabricated elements are placed and assembled inside the annular truncated cone in a dry dock, before launching of the truncated cone. The construction time is reduced since the elements can be fabricated separately and simultaneously in different workshops.

The resulting composite platform is very light and has a shallow draught. (For a platform 140 meters outside diameter at the base and 100 meters O.D. at the deck level the draught is only 8 meters).

The upper peripheral ring 14 of the annular truncated cone 12 is increased in height by a superstructure 15*a* of a height corresponding to the upper deck 3. This superstructure is provided with devices (not shown) for retaining the piles, in such a manner as to support the piles 17 in lifted position during the towing of the platform.

FIG. 3 shows the platform viewed from the top; the openings of the watertight passage tubes 15 for piles 17 is in the middle of the circular running track 9 where the cranes 10 roll. The drilling rigs are placed on one half of the deck, derricks 3 and 4 being mounted for transverse sliding on a frame 19, which slides longitudinally on rails 19*a* permitting displacement on all the surfaces of the drilling grids 20. Drill pipe equipment is kept in the pipe-rack 21 which is common to both derricks, while the mud tanks, cementing units, generators, etc. are placed in 22 between the derricks 4, 5 and the living quarters 6.

The lower deck 23 of FIG. 2 shown in FIG. 4 is above maximum sea level, and is placed at the lower level of the upper peripheral ring 14 of the annular truncated cone 12. Deck 23 carries on its periphery the storage tanks 24*a* and the auxiliary machines 24.

Near the centre, and vertically in line with the drilling grids 20, are provided the drill pipe passages 25. The opening of at least one circular, bottomless drilling shaft 26, is placed in the drilling grids. This moonpool is watertightly mounted inside the lower story and welded to the bottom. This assembly is very similar to that installed on the drilling ships called "moon pool". This drilling shaft allows drilling strings to pass through and maintain the watertightness of the hull avoiding the need to drill through the bottom. Prospecting generally comprises the drilling of three holes, made through the drilling shaft 26. If the prospected area gives no results, the holes are cemented and the well head extensions are cut at the seabed level. There is no need for watertight sealing-off of the structure before bottom floating it up to move to another site. If on the other hand the prospecting holes are found to be productive, the well drilling is continued until all the holes allowed for in the drilling grids 20 are completed. Drilling can be done simultaneously with the two drilling rigs 4 and 5. In the example illustrated in FIGS. 3, 4 and 5, each grid allows drilling of eighteen wells, so with two grids thirty-six wells can be drilled, two by two, by displacing each derrick above its drilling grid. If the development of the field has been decided on, it is no longer necessary to shift the platform, as drilling can be made by classical means through the steel bottom of the platform, as shown in FIG. 5, the tightness of the hull then being ensured by the radial partition walls 27 and the polygonal partition walls 28 and 29. The bottom story 39 (FIG. 2) placed between the platform bottom and the lower deck has periphery watertight chambers 31 serving as water ballast and, near its center, the drill pipe passages. the fuel tanks 32 (for engines and other auxiliaries) and the central pump room 33.

The operation of the platform according to the invention is described below.

The platform including its complete installation is towed to the site, the piles 17 being in the raised position, the top of the piles being approximately at the level of the upper deck. The platform is ballasted in such a manner that it immerses in horizontal position until it rests on the seabed. The ballastable tanks 12*a* of the annular truncated cone 12 and the watertight ballast chambers 31 provided in the lower platform story are filled with water. The piles 17 are then lowered and driven by vibrating pile drivers (not shown) hanging from cranes onto the heads of the piles; this pile driving cooperates with hydraulic driving nozzles provided at the lower end of the piles these so-entering the piles across the mud layer down to firm ground. When the platform is secured by the piles, the drilling of the wells can start.

When the platform has to be transferred to another site, the gantries of the cranes are placed above each pile. The pile is attached to a winch placed on the gantry and extracted from the seabed, using the same techniques of vibration and hydraulic jetting as for the pile driving operation.

The prospecting drill pipes passing through the drilling shaft are cemented and cut off.

The tanks in the annular truncated cone and in the central cylindrical shaft are deballasted, to obtain a positive buoyancy. The platform is then floated and towed to a new site.

If during prospecting drilling the results are considered to be interesting, the platform is kept in position and the production drilling can start immediately, using the two derricks.

The equipment and stock of material on the platform are sufficient to allow a drilling compaign lasting several months without restocking.

Known means are provided to prevent freezing of water ballast.

The platform may consist of a frustoconical ring of concrete and be provided with a circular central bottom of metal watertightly fixed in the inner wall of the ring, without departing from the scope of the invention. In this case the decks are supported by a steel structure directly resting on the bottom in order to withstand the weight of the installations and the weight of any ice which may be formed on the installations, so avoiding the thickening of the inner cylindrical wall of the frustoconical ring.

We claim:

1. A composite movable platform for use in petroleum explorations and drillings in polar seas, comprising a frustoconical first base section designed to be supported on the seabed, a cylindrical central second section, and a deck supported by said first and second sections for supporting drilling and production equipment, said first base section being formed as a watertight concrete structure and having the shape of a right-angled triangle and adapted to rest on the seabed on one side of the right angle, the hypotenuse of said triangle being a peripheral frustoconical wall and the third side of the triangle forming an inner cylindrical wall, the volume formed inside said walls forming ballastable tanks, and the apex opposite said one side being truncated and forming above sea level a peripheral ring in which are provided watertight passage tubes receiving anchoring piles parallel to said inner cylindrical wall, and wherein the cylindrical center second section is composed of at least one circular bottom, the said second section being housed inside the inner cylindrical wall of the concrete annular truncated cone and fixed watertightly to said wall, the bottom of the annular truncated cone and the circular bottom being in the same plane.

2. The platform as claimed in claim 1, which is provided, inside the inner cylindrical section, with a bottomless passage shaft passing watertight through the bottom of said section and housing drill pipes.

3. The platform as claimed in claim 1, wherein the peripheral ring supports a superstructure on which is installed a running track in the middle of which are provided the openings of the watertight passage tubes for the piles, said track serving for the displacement of gantry cranes.

4. The platform as claimed in claim 2, wherein the crane gantries are equipped with a winch for raising the piles.

5. The platform as claimed in claim 1, wherein the elements of the inner cylindrical section are prefabricated separately and at the same time as the annular truncated cone, in order to be assembled inside the annular truncated cone in a dry dock after completion of the annular truncated cone and before the launching of the platform.

6. The platform as claimed in claim 1, wherein the drilling equipment consists of two drilling derricks sliding on a sliding frame disposed at the center of the platform inside the running track.

* * * * *